US007213784B2

(12) United States Patent
Lundahl

(10) Patent No.: US 7,213,784 B2
(45) Date of Patent: May 8, 2007

(54) PLASTIC BOBBIN AND A METHOD OF MANUFACTURING SUCH A BOBBIN

(75) Inventor: Sven-Ingvar Lundahl, Hovmantorp (SE)

(73) Assignee: AB Underphone, Taby (SE)

( * ) Notice: Subject to any disclaimer, the term of this patent is extended or adjusted under 35 U.S.C. 154(b) by 0 days.

(21) Appl. No.: 10/502,297

(22) PCT Filed: Jan. 23, 2003

(86) PCT No.: PCT/SE03/00107

§ 371 (c)(1),
(2), (4) Date: Jul. 22, 2004

(87) PCT Pub. No.: WO03/064308

PCT Pub. Date: Aug. 7, 2003

(65) Prior Publication Data

US 2005/0103922 A1 May 19, 2005

(30) Foreign Application Priority Data

Jan. 30, 2002 (SE) ..... 0200251

(51) Int. Cl.
*B65H 75/22* (2006.01)
*B65H 75/18* (2006.01)

(52) U.S. Cl. ..... 242/610.2; 242/608; 242/118.8; 242/172; 206/55; 206/395

(58) Field of Classification Search ..... 242/608, 242/607.1, 607.2, 609.1, 604, 604.1, 172, 242/610.2, 610.3, 118.8; 206/55, 395, 396
See application file for complete search history.

(56) References Cited

U.S. PATENT DOCUMENTS 1,437,954 A 12/1922 Balke
2,852,206 A * 9/1958 Bolding ..... 242/118.8
3,284,022 A * 11/1966 Eifrid ..... 242/607.1
3,565,363 A * 2/1971 Mizuguchi et al. ..... 242/608.4
3,791,606 A * 2/1974 Brown ..... 242/607.1
3,817,475 A * 6/1974 Goldstein ..... 242/607.1
4,437,618 A * 3/1984 Boyle ..... 242/610.2
4,880,181 A * 11/1989 Drahanowsky ..... 242/345
5,287,965 A * 2/1994 Miller ..... 206/396
5,513,819 A * 5/1996 Orange ..... 242/610.2
5,647,557 A * 7/1997 Faulkner ..... 242/607.1
5,791,590 A * 8/1998 Zuk et al. ..... 242/610.6
6,021,974 A * 2/2000 Koskelainen ..... 242/593
6,527,220 B2 * 3/2003 Weaver et al. ..... 242/603

FOREIGN PATENT DOCUMENTS

| | | |
|---|---|---|
| GB | 1 303 063 | 1/1973 |
| SE | 469 836 | 9/1993 |
| WO | WO 91/04218 | 4/1991 |

* cited by examiner

*Primary Examiner*—Emmanuel Marcelo
*Assistant Examiner*—Evan H. Langdon
(74) *Attorney, Agent, or Firm*—Harness, Dickey & Pierce

(57) ABSTRACT

A bobbin (1) of plastic has a cylinder (2) and, formed integrally therewith, circumferential end flanges (3) and is made of a U-shaped channel. Each end flange (3) consists of a plurality of spaced-apart, essentially radial flange elements (4) which are distributed along the circumference of the cylinder (2). In a method of manufacturing such a bobbin, a U-shaped channel is made by injection moulding. The U shaped channel is given such a shape that its side walls consist of a plurality of spaced-apart wall elements which are distributed along the length of the channel. The channel is bent to form the cylinder (2) and its ends are connected with each other in this bent position.

12 Claims, 4 Drawing Sheets

PLASTIC BOBBIN AND A METHOD OF MANUFACTURING SUCH A BOBBIN

FIELD OF THE INVENTION

The present invention relates to a bobbin of plastic, which has a cylinder and, formed integrally therewith, circumferential end flanges and is made of a U-shaped channel, and a method of manufacturing such a bobbin, in which method a U-shaped channel is made and bent to form said cylinder with end flanges, the ends of the channel being connected with each other in this bent position.

BACKGROUND ART

Bobbins are used for winding, inter alia, cable, and they can be manufactured in various ways and of various materials. In small sizes, up to about 400 mm, they are in most cases made of plastic or paper. They can be manufactured in one piece or several pieces which are then assembled.

GB-1,303,063 discloses manufacture of a bobbin by bending a plastic channel back on itself so that its ends meet and a cylinder with circumferential end flanges is formed, after which the ends are joined by welding or gluing. The plastic channel is made by extrusion or thermoforming of a plastic strip and is provided with transverse corrugations to allow it to be bent to a cylinder.

The drawbacks of this method of manufacture is that it is time-consuming since manufacture takes place in several steps and different machines or tools are required for each step, and that the corrugation requires a great consumption of material.

SUMMARY OF THE INVENTION

The object of the invention is to provide a method that makes it possible to simplify the manufacture of a bobbin of the above type and to reduce the consumption of material. A further object of the invention is to provide such a bobbin which can be made of a smaller amount of material compared with the prior-art bobbin of a corresponding size and further has the advantage that it can be transported and stored in a more rational manner.

This object is achieved as regards the bobbin by a bobbin which is of the type mentioned by way of introduction and characterised in that each end flange consists of a plurality of spaced-apart essentially radial flange elements which are distributed along the circumference of the cylinder.

For the end flanges of the bobbin to have sufficient strength, its flange elements have over their entire radial extent preferably an essentially constant extension in the circumferential direction, the flange elements of each end flange having a total extension in the circumferential direction which is essentially equal to the circumference of the cylinder.

In order to facilitate bending, the bobbin has preferably a plurality of axial grooves which are formed in the outer circumferential surface of the cylinder, each groove extending the entire length of the cylinder between a point between two adjoining flange elements of one end flange and a point between two adjoining flange elements of the other end flange.

Each flange element has at its radially inner end suitably a lug, which extends past the inner circumferential surface of the cylinder and has a circumferential extent that decreases radially inwards. The U-shaped channel can be bent until each lug has been brought into abutment against a neighbouring lug. Thus the lugs make it easier to form the U-shaped channel to a cylinder which retains its cylindrical shape and does not collapse when used. In an alternative embodiment, the inner circumferential surface of the cylinder has a plurality of axial grooves, each groove extending the entire length of the cylinder between a point between two adjoining flange elements of one end flange and a point between two adjoining flange elements of the other end flange. The grooves in the inner circumferential surface of the cylinder are preferably located opposite to the grooves in the outer circumferential surface thereof and are preferably wedge-shaped in cross-section.

Preferably, at least one flange element of one end flange has at its radially outer end an articulated projection which at its free end is hookable onto the other end flange.

The above object is achieved as regards the method by the U-shaped channel being made by injection moulding and given such a shape that its side walls consist of a plurality of spaced-apart wall elements which are distributed along the length of the channel.

The ends of the channel are preferably connected with each other by protrusions, which are formed on a projection of the base of the channel, which projection projects at one channel end in the longitudinal direction of the channel, being inserted into holes which are formed in the base of the channel at the other channel end.

In order to facilitate bending of the channel, its base is during injection moulding given transverse inner grooves which extend the entire width of the base between a point between two adjoining wall elements of one channel wall and a point between two adjoining wall elements of the other channel wall.

Preferably, each wall element is during injection moulding at its end connected with the base provided with a lug which extends past the base and has an extent decreasing in the longitudinal direction of the channel, away from the wall element, the channel being bent until each lug is brought into abutment against a neighbouring lug, the lugs forming stops which make the channel form to a cylinder in connection with bending. Alternatively, the base of the channel can during injection moulding be given transverse outer grooves which extend the entire width of the base between a point between two adjoining wall elements of one channel wall and a point between two adjoining wall elements of the other channel wall.

BRIEF DESCRIPTION OF THE DRAWINGS

The invention will now be described in more detail by means of a preferred but non-limiting embodiment and with reference to the accompanying drawings.

DESCRIPTION OF PREFERRED EMBODIMENTS

Figure 1:
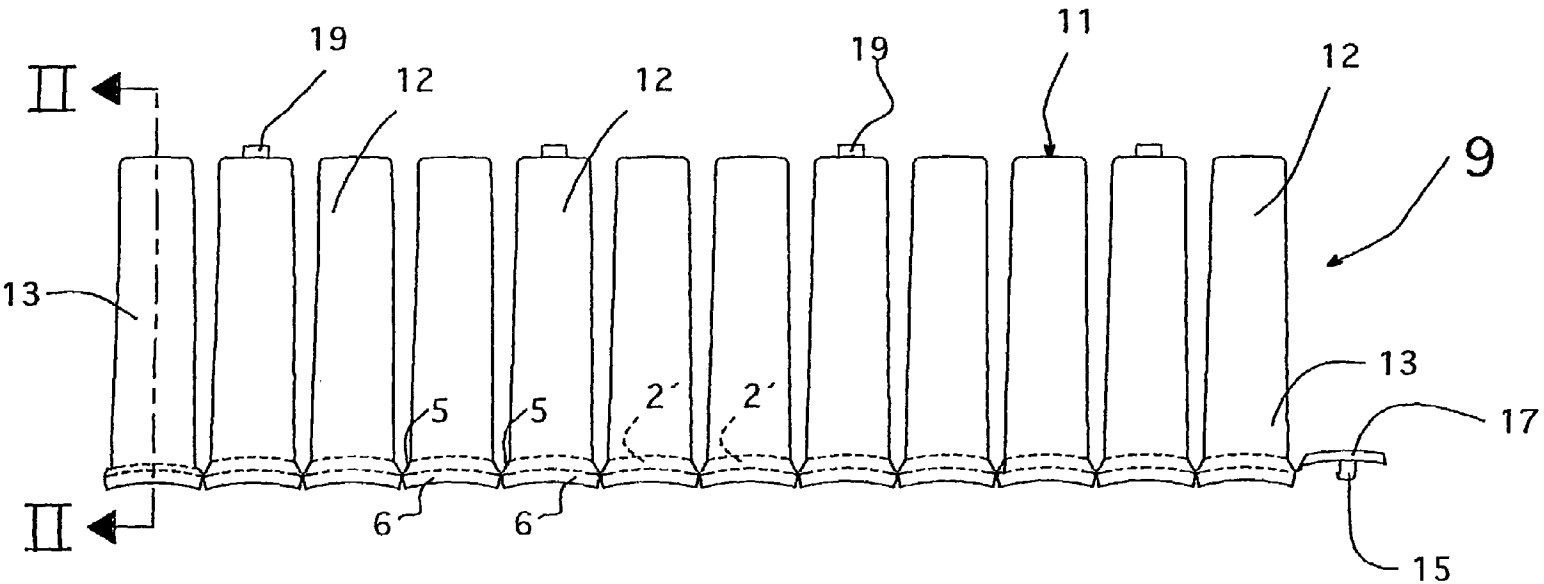
FIG. 1 is a side view of a U-shaped channel which is used to manufacture a bobbin according to the invention.

The bobbin 1 according to the invention is made of plastic and has a cylinder 2 with a circumferential end flange 3 at each cylinder end. Each end flange 3 consists of a plurality of spaced-apart radial flange elements 4, which are perpendicular to the cylinder axis and uniformly distributed along the circumference of the cylinder 2. In the preferred embodiment, all flange elements 4 have the same shape and size, but they could just as well have different shapes and/or sizes. The flange elements 4 have essentially the shape of an elongate rectangle, each flange element being connected with the cylinder 2 at one short side of the rectangle. The total width of the flange elements 4 of each end flange 3 is approximately equal to the circumference of the cylinder 2. For increased strength, the flange elements 4 are internally provided with radial stiffeners 14, or they are arched in cross-section.

Each flange element 4 of one end flange 3 is arranged opposite to a flange element 4 of the other end flange 3. Between the flange elements 4 in each pair of adjoining flange elements, the cylinder 2 has axial grooves 5 in its outer circumferential surface. The grooves 5 extend the entire length of the cylinder 2.

In an alternative embodiment (not shown), also the inner circumferential surface of the cylinder has axial grooves between the flange elements 4 in each pair of adjoining flange elements, which grooves extend the entire length of the cylinder 2 and are wedge-shaped in cross-section.

Figure 3A:
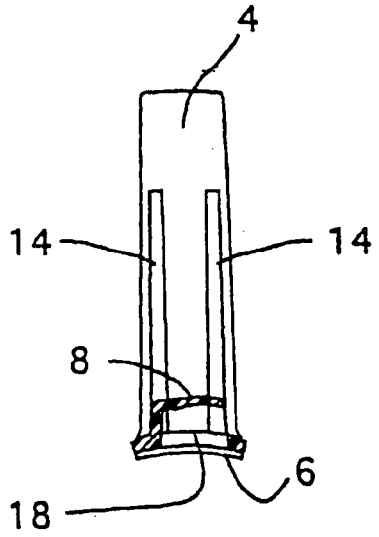
FIG. 3A shows the channel segment in section along line IIIA—IIIA in FIG. 2.
Figure 3B:
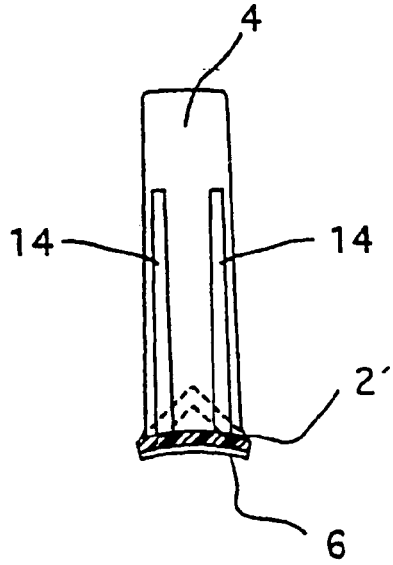
FIG. 3 shows the channel segment in section along line IIIB—IIIB in FIG. 2.

Each cylinder portion 2' between two adjoining grooves 5 is outwardly arched in cross-section, as is evident from FIG. 3B, or inwardly arched in cross-section. To provide a more rigid cylinder, these portions 2' can be made more pointed in cross-section, as indicated by dashed lines in FIG. 3B.

Figure 4:
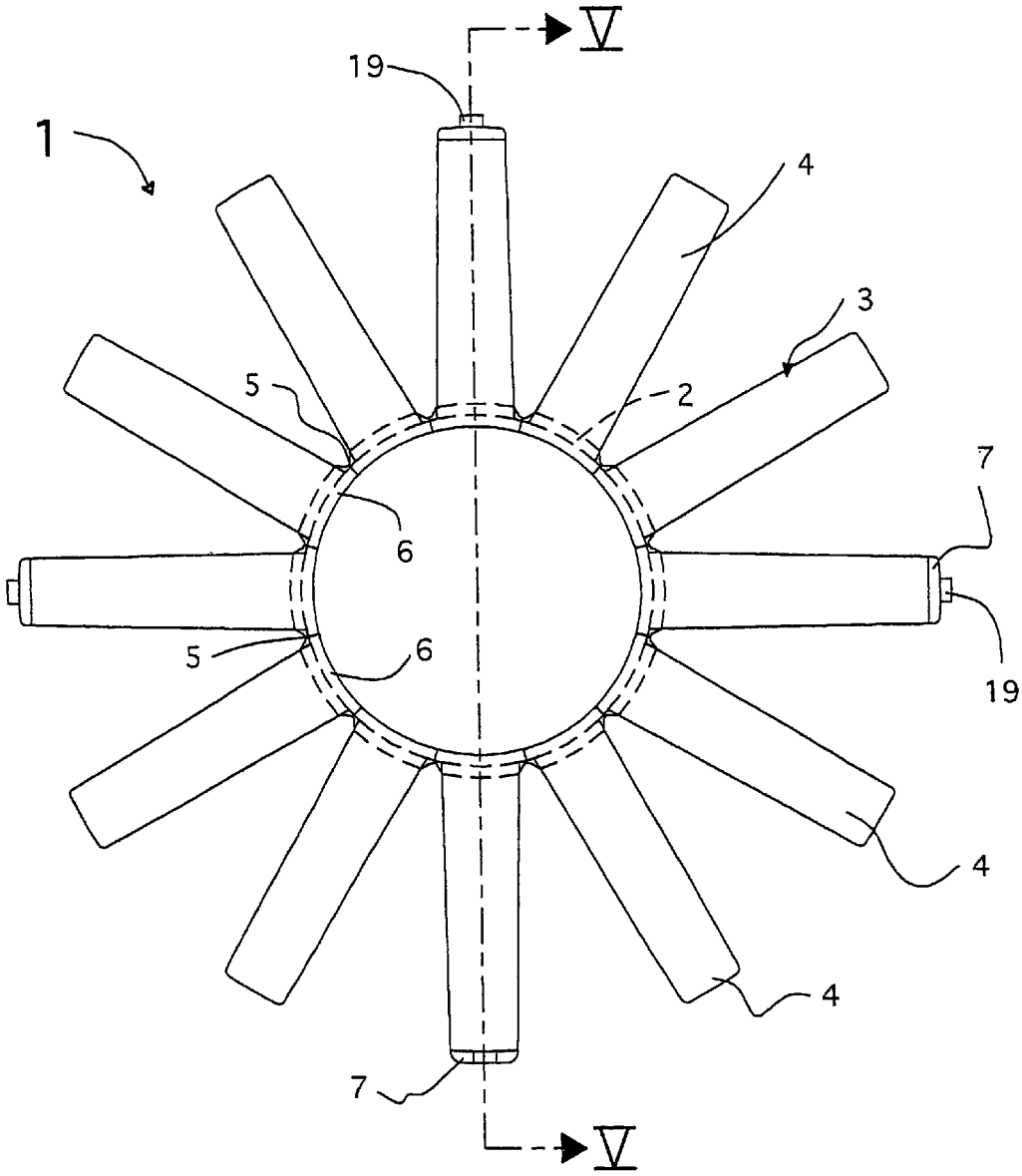
FIG. 4 is an end view of a bobbin which is made of a bent channel according to FIGS. 1 and 2.
Figure 5:
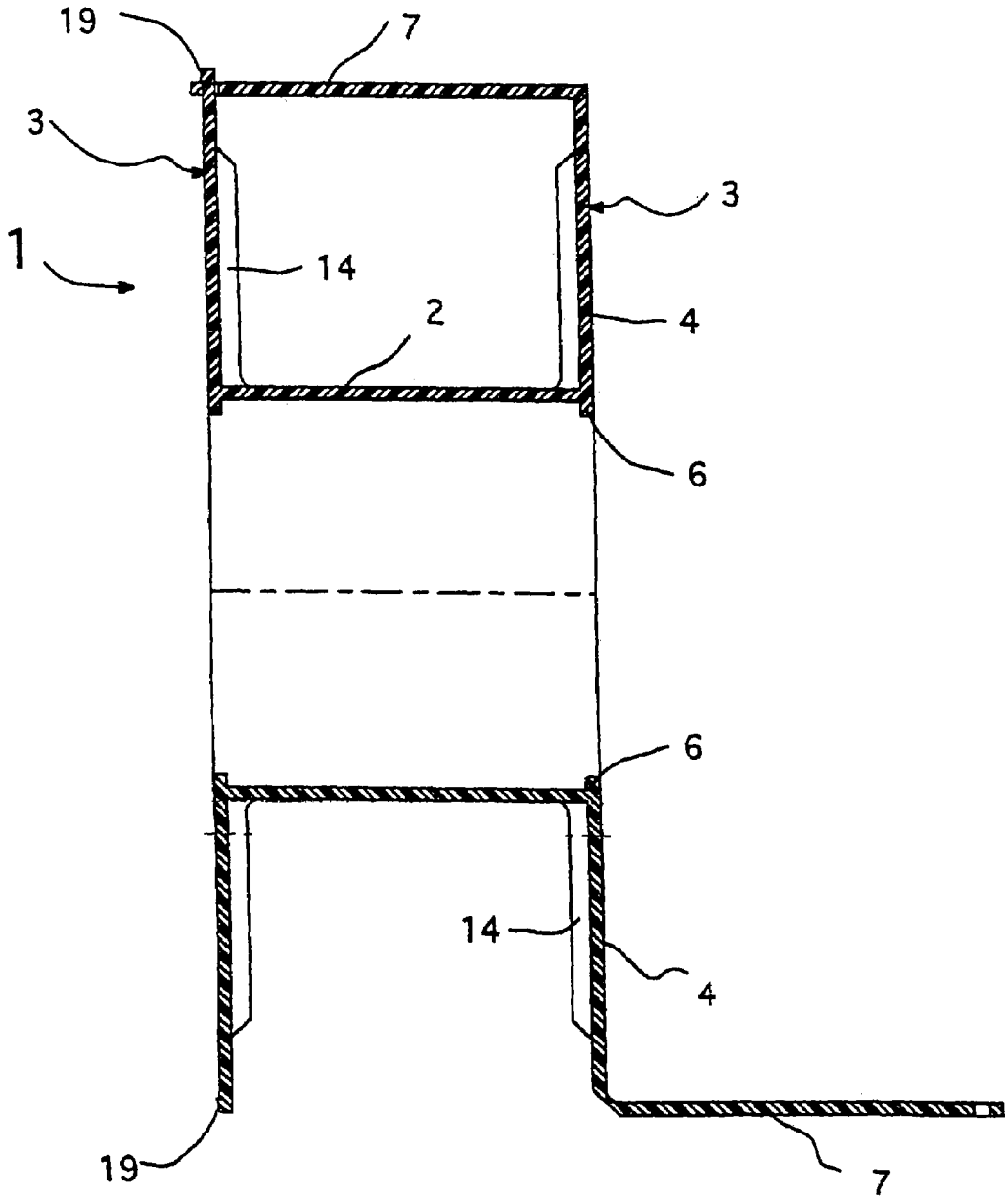
FIG. 5 is a sectional view along line V—V in FIG. 4 and shows the bobbin.

Each flange element 4 has at its radially inner end a lug 6 which extends past the inner circumferential surface of the cylinder 2 and has a circumferential extent that tapers radially inwards (see FIGS. 1 and 4). Each lug 6 tapers radially inwards in such a manner that, seen in the axial direction, it has the shape of a radially outer part of a sector of a circle, whose radius is equal to the inner radius of the cylinder 2 and whose point angle is 360°/N, where N equals the number of flange elements of each end flange 3.

One or more flange elements 4 of one end flange are at their radially outer end provided with an articulated projection 7, whose free end is to be hooked onto a hook 19 on a flange element 4 of the other end flange, so that the projection 7 forms a transport cover for a cable wound onto the bobbin.

The outer circumferential surface of the cylinder 2 has a hook 8 on which a cable end can be fastened when winding a cable onto the bobbin.

According to the invention, the bobbin 1 is manufactured by a U-shaped channel 9 being injection moulded of plastic and then being bent back on itself to form a cylinder 2 with an end flange 3 at each cylinder end. The base 10 of the U-shaped channel 9 forms the cylinder 2 and its walls 11 form the end flanges 3. To allow the channel 9 to be bent back on itself, its walls 11 consist of a plurality of essentially rectangular wall elements 12 which are spaced from each other and uniformly distributed along the length of the channel 9. When the channel 9 is bent, the wall elements 12 are moved apart in the manner as is evident from FIG. 4.

Figure 2:
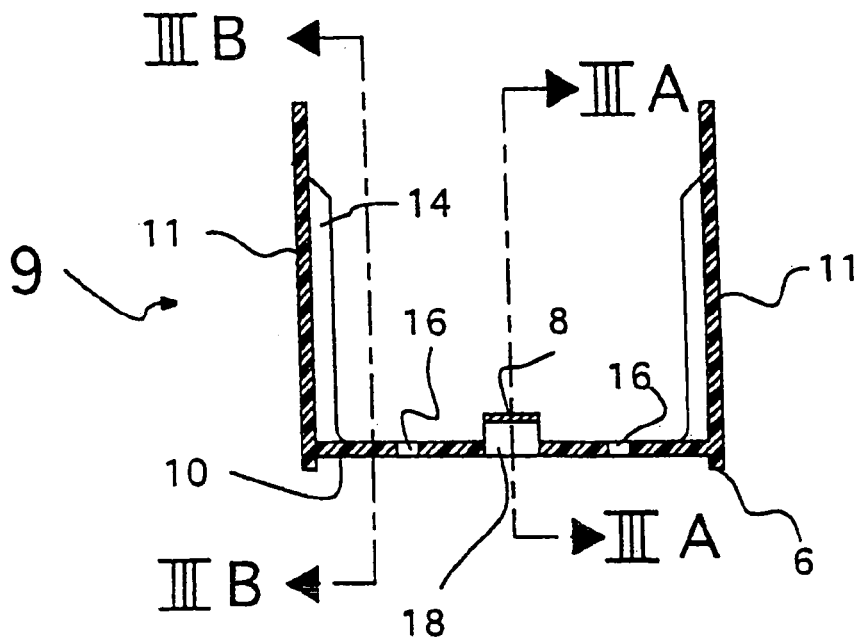
FIG. 2 is a sectional view along line II—II in FIG. 1 and shows a channel segment of the channel.

The channel ends 13 are connected with each other by protrusions 15, here having the shape of hooks, which are formed on a projection 17 of the base 10 of the channel, said projection projecting at one channel end 13 in the longitudinal direction of the channel 9, being inserted into holes 16 which are formed in the base of the channel at the other channel end 13 (FIG. 2). Of course, it is also conceivable to form the holes in the projection 17 at one channel end 13 and the protrusions at the other channel end 13.

The base projection 17 provided with the protrusions 15 at one channel end 13 also has an opening 18 through which the hook 8, which is formed at the other channel end 13, is inserted when interconnecting the channel ends 13.

In an alternative embodiment (not shown), the channel ends are connected with each other by the projection at one channel end being inserted between two holder elements extended in the longitudinal direction of the channel and being essentially L shaped in cross-section, at the channel end opposite to the projection. The first L legs of the two holder elements are attached to the base. The two free second L legs are oriented towards each other and form supporting portions for the projection when this is inserted between the holder elements when interconnecting the channel ends. A stop lug is arranged on the base of the channel between the two holder elements, the projection being formed with a hole into which the stop lug is inserted once the channel ends are connected with each other. The holder elements are preferably arranged on the outside of the base of the channel so that the completed bobbin obtains a smooth outer circumferential surface.

The base 10 of the channel 9 is formed with transverse inner grooves 5 which make the channel easier to bend.

To facilitate the forming of a cylinder 2 when bending the U-shaped channel 9, and to prevent the cylinder from collapsing when using the bobbin 1, each wall element 12 is provided with a lug 6 which extends past the base 10 and has an extent decreasing in the longitudinal direction of the channel 9, away from the wall element. The channel 9 can be bent until each lug 6 is brought into abutment against a neighbouring lug 6. Alternatively, the base 10 of the channel is during injection moulding given transverse outer grooves which extend the entire width of the base between a point between two adjoining wall elements 12 of one channel wall 11 and a point between two adjoining wall elements 12 of the other channel wall 11.

The bobbin according to the invention can be used not only for winding cable, but also for winding, for instance, rope, line, hose, emery cloth and the like. The bobbin can also serve as a spacing or insulating element in large drums or pipes with cables inserted into the tube which is formed of the cylinder of the bobbin.

The invention claimed is:

1. A method of manufacturing a bobbin of plastic comprising:

injection moulding a one piece U-shaped channel, the one piece U-shaped channel having a plurality of cylinder elements, two circumferential end flanges and inner grooves between adjacent cylinder elements, each of the plurality of cylinder elements has a curved, radially inner surface and each end flange includes a plurality of spaced-apart, radial flange elements;

bending the U-shaped channel until sides of the inner grooves abut each other; and connecting ends of the U-shaped channel with each other in a position so the curved, radially inner surface of the plurality of cylinder elements form an inner circumference of a cylinder.

2. A method as claimed in claim 1, wherein the connecting includes inserting into holes formed in a cylinder element of the U-shaped channel at a first end of the U-shaped channel protrusions formed on a projection at a second end of the U-shaped channel.

3. A method as claimed in claim 1, wherein the injection moulding a one piece U-shaped channel includes forming the inner grooves which extend an entire width of the U-shaped channel.

4. A method as claimed in claim 1, wherein the injection moulding a one piece U-shaped channel includes providing at an end of each flange element connected with a cylinder element of the U-shaped channel a lug which extends past the cylinder element and has an extent decreasing in a longitudinal direction of the U-shaped channel, and the bending the U-shaped channel to form a cylinder includes bending the U-shaped channel until each lug is brought into abutment against a neighbouring lug.

5. A method as claimed in claim 1, wherein the injection moulding a one piece U-shaped channel includes forming outer grooves which extend an entire width of the U-shaped channel.

6. A bobbin of plastic comprising:

a one-piece injection moulded U-shaped channel, wherein the U-shaped channel includes a plurality of cylinder elements each having a curved radially inner surface at the time the U-shaped channel is injection moulded and prior to the U-shaped channel being bent to form a cylinder, so that when the U-shaped channel is bent to form the cylinder, the curved radially inner surface of each cylinder element is connected to at least one adjacent cylinder element by plastic thinner than the at least one adjacent cylinder element and abuts against two adjacent cylinder elements to form an inner circumference of the cylinder.

7. A bobbin as claimed in claim 6, wherein the U-shaped channel includes two end flanges, each end flange having a plurality of flange elements having a constant extension in a circumferential direction that is equal to the circumference of the cylinder.

8. A bobbin as claimed in claim 7, in which each flange element has a lug at a radially inner end, the lug is shaped to abut an adjacent lug when the U-shaped channel is bent to form the cylinder.

9. A bobbin as claimed in claim 6, in which a plurality of axial grooves are formed in a radially outer surface of the U-shaped channel that is an outer circumferential surface of the cylinder, each groove extending an entire width of the U-shaped channel between two adjacent cylinder elements.

10. A bobbin as claimed in claim 6, in which at least one flange element of one end flange has an articulated projection configured to hook onto the other end flange.

11. A bobbin as claimed in claim 6, in which a plurality of axial grooves are formed in a radially inner surface of the U-shaped channel that is an inner circumferential surface of the cylinder, each groove extending an entire width of the U-shaped channel between two adjacent cylinder elements.

12. A bobbin as claimed in claim 11, in which the plurality of axial grooves formed in the radially inner surface of the U-shaped channel are wedge-shaped in cross-section.

* * * * *